US005258018A

United States Patent [19]

Van Nostrand

[11] Patent Number: 5,258,018

[45] Date of Patent: * Nov. 2, 1993

[54] AQUATIC APPARATUS AND METHOD FOR PRODUCING MILD TRACTION

[76] Inventor: Willard R. Van Nostrand, 3737 Calle Cortez, Tucson, Ariz. 85716

[ * ] Notice: The portion of the term of this patent subsequent to Apr. 21, 2009 has been disclaimed.

[21] Appl. No.: 839,955

[22] Filed: Feb. 21, 1992

Related U.S. Application Data

[63] Continuation-in-part of Ser. No. 535,366, Jun. 8, 1990, Pat. No. 5,105,804.

[51] Int. Cl.[5] ..... B61H 1/02

[52] U.S. Cl. ..... 606/241; 441/108; 4/573.1

[58] Field of Search ..... 606/241; 441/116, 123, 441/129, 76, 77, 81, 88, 108, 113; 4/573.1, 575.1; 482/55, 105, 111, 112

[56] References Cited

U.S. PATENT DOCUMENTS

| | | | |
|---|---|---|---|
| 1,827,057 | 10/1931 | Wills | 441/108 |
| 2,145,289 | 1/1939 | Boudreaux | 9/17 |
| 4,293,126 | 10/1981 | Havens | 482/55 X |
| 4,396,012 | 8/1983 | Cobiski | 606/241 |
| 4,551,108 | 11/1985 | Bass | 441/116 |
| 4,632,387 | 12/1986 | Guzman | 482/111 |
| 4,722,329 | 2/1988 | Kalvag | 606/241 |
| 4,798,497 | 1/1989 | Bloos | 482/105 X |
| 4,798,550 | 1/1989 | Biancucci | 441/129 |
| 4,800,871 | 1/1989 | Florjancic | 606/241 |
| 4,804,177 | 2/1989 | Rosson | 482/55 |
| 4,905,991 | 3/1990 | Alston | 482/55 X |
| 5,092,589 | 3/1992 | Packer | 441/129 X |
| 5,105,804 | 4/1992 | Van Nostrand | 606/241 |

FOREIGN PATENT DOCUMENTS

| | | |
|---|---|---|
| 296348 | 1/1973 | U.S.S.R. . |
| 587936 | 1/1978 | U.S.S.R. . |
| 502532 | 8/1979 | U.S.S.R. . |
| 0741873 | 6/1980 | U.S.S.R. . |
| 745519 | 7/1980 | U.S.S.R. . |
| 1162427 | 6/1985 | U.S.S.R. . |
| 1181659 | 9/1985 | U.S.S.R. . |
| 1292764 | 2/1987 | U.S.S.R. . |
| 1304812 | 4/1987 | U.S.S.R. . |
| 1409260 | 7/1988 | U.S.S.R. . |

OTHER PUBLICATIONS

"Gravity Lumbar Reduction" by Charles V. Burton, *Managing Low Back Pain,* pp. 305–314, Second Edition.

"Function and Pathomechanics of the Sacroiliac Joint, A Review" Reprinted from the Journal of American Physical Therapy Assn. vol. 65, No. 1, Jan. 1985, pp. 35–44.

*Primary Examiner*—Edgar S. Burr
*Assistant Examiner*—Christopher A. Bennett
*Attorney, Agent, or Firm*—Cahill, Sutton & Thomas

[57] ABSTRACT

A system for producing mild traction on intervertebral discs by supporting a person in water in a deep spa or pool either by means of a soft neck collar supported by the water or a soft, flexible floating annular floatation device engaging undersides of the person's arms adjacent to the person's armpits without compressing the person's chest and constricting the person's breathing. The spa or pool is sufficiently deep that the person's feet cannot touch the bottom thereof. A submerged weight belt is supported on each of the person's ankles, the weight belts each having a buoyant weight in the range from one to two pounds. The temperature of the water in the spa is maintained at approximately 96 degrees Fahrenheit by conventional heating and thermostatic devices to allow adequate removal of the person's metabolic heat without causing tonicity of the person's muscles. The level of inflation of the collar can be adjusted to adjust the level of traction In another embodiment of the invention, contractions of neurologically disabled muscles are produced in a first limb of a person by supporting the person in water in the deep spa or pool either by means of a soft, flexible annular floatation device engaging undersides of the person's arms or by means of a soft neck collar supported by the water. The person is caused to extend an opposite second limb outward under voluntary control of muscles of that limb, and muscles of the disabled first limb automatically contract so as to counterbalance the opposite second limb.

6 Claims, 4 Drawing Sheets

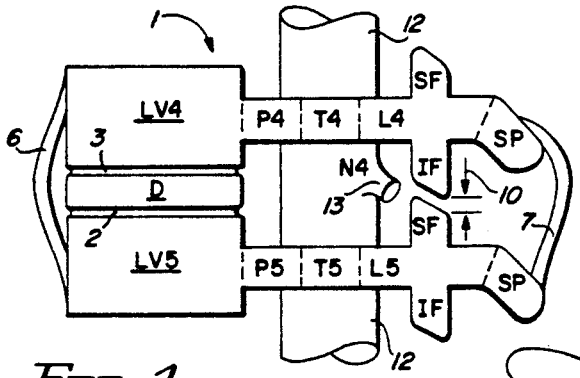
FIG. 1
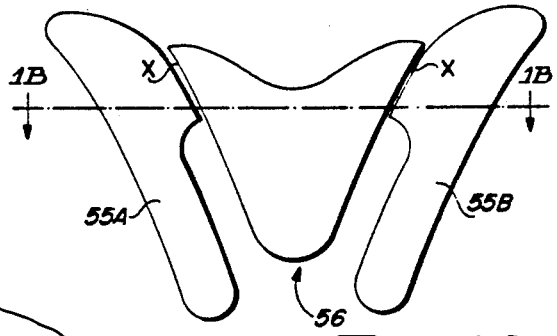
FIG. 1A
FIG. 3
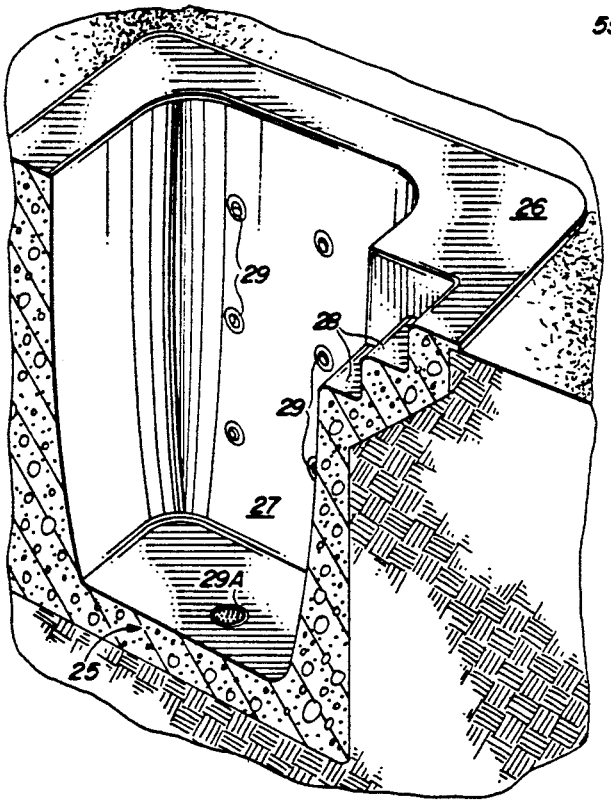
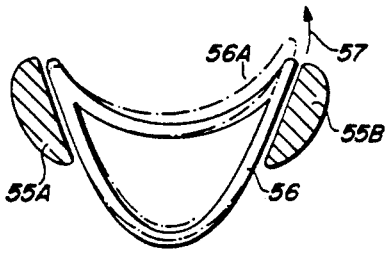
FIG. 1B
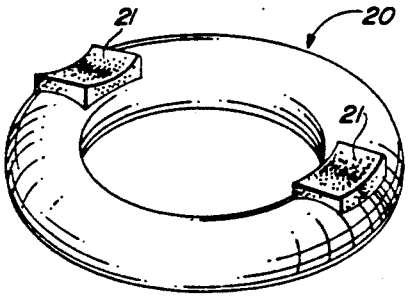
FIG. 2
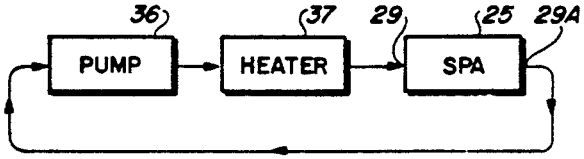
FIG. 4

AQUATIC APPARATUS AND METHOD FOR PRODUCING MILD TRACTION

CROSS-REFERENCE TO RELATED APPLICATIONS

This application is a continuation-in-part of my allowed copending patent application Ser. No. 535,366, filed Jun. 8, 1990, and entitled "APPARATUS AND METHOD FOR PRODUCING MILD, SUSTAINED BALANCED TRACTION ON THE LOWER BACK", now U.S. Pat. No. 5,105,804.

BACKGROUND OF THE INVENTION

The invention relates to an aquatic apparatus and method for a) treatment of patients with neck and back pain, b) rehydrating intervertebral discs, c) mobilizing arthritic and post-operative joints, and d) exercising limbs with neuromuscular impairment, including that caused by strokes.

It is well known to physicians that a significant cause of lower back pain is pinching of nerves due to collapsing of vertebral discs in the lumbar spine, and that the resulting pain could be prevented if a better way could be found to avoid premature dying of intervertebral disc cells. The premature dying of disc surface tissue results in the thinning or collapsing of the cells. The dying of intervertebral disc cells occurs as a result of lack of nourishment. Nourishment of the discs occurs as a result of passive diffusion of nutrient-containing fluids along the upper and lower surfaces of such discs. The nutritional fluids providing the upper and lower disc surfaces with nutrients and water move by passive diffusion along osmotic and hydrostatic gradients in the passages within the vertebral discs and between the adjacent lumbar vertebrae. Consequently, any continually exerted hydrostatic pressure that prevents such passive diffusion also prevents adequate nourishment and hydration of the disc surfaces. This results in premature, unrenewable loss of surface disc cells. In FIG. 1, D designates an intervertebral disc. LV4 designates the fourth lumbar vertebra, LV5 designates the fifth lumbar vertebra, P4 designates the pedicles of L4, L4 designates the lamina of L4, and N4 designates the nerve exiting by L4. S indicates "superior", I indicates "inferior", so SF designates the superior facet, and IF designates the inferior facet. Those skilled in the art know that the thoracic spine includes the thoracic vertebrae commonly designated T1–T12, and the lumbar spine includes the lumbar vertebrae commonly designated L1–L5.

Very shallow spaces 2 and 3 exist above and below disc D, between it and lumbar vertebrae LV4 and LV5. The nutrient fluids and gases must diffuse through spaces 2 and 3 every day to nourish the upper and lower surfaces of disc D if premature dying of disc cells is to be avoided.

If the person is awake and involved in normal activities such as standing or sitting, the weight of the person's upper body compresses the lumbar vertebrae LV4 and LV5 against the upper and lower surfaces of disc D, completely eliminating spaces 2 and 3, effectively sealing off the upper and lower surfaces of disc D from the nutrient fluids. When the person sleeps, spaces 2 and 3 ordinarily will open enough to allow diffusion of the nutrient solution and thereby allow adequate nourishment and hydration of the upper and lower surfaces of disc D, because the sleeping person usually is horizontal and his or her body weight does not compress lumbar vertebrae LV4, disc D, and lumbar vertebrae LV5 enough to completely close off passages 2 and 3 to diffusion of the nutrient fluid.

All of the weight of a person's upper body is transferred through the spine into the sacro-iliac joints, which are designed as a double wedge from the top to bottom and from the front to back. FIGS. 1A and 1B illustrate the normal positional relationship of the ilium 55A,B and the sacrum 56. The dotted lines 56A illustrates how the sacrum 56 can become asymmetrically "wedged" against the right hand portion 55B of the ilium 55A,B as the sacrum 56 moves forward toward the front of the person. This happens when the person subjects the sacrum 56 to asymmetrical force or torque that causes only the right hand portion of sacrum 56 to move forward in the direction of arrow 57, and the "wedging" of portion 55B of the ilium prevents sacrum 56 from returning to its normal position from the position indicated by dotted lines 56A.

FIG. 1B shows a rear view of the sacrum 56 and the ilium 55A,B, wherein the letter X designates space between the interface surfaces at which the "wedging" occurs between sacrum 56 and ilium 55A,B. When the sacrum is wedged into the position indicated by dotted lines 56A in FIG. 1B, lower back pain is the result. Conventional traction techniques attempt to remove the sacrum from the position 56A to the position 56 in FIG. 1B. Mild traction can have the effect of tending to increase the spaces designated by letter X in FIG. 1A, effectively "lifting" the sacrum upward from the ilia enough to avoid the above wedging, allowing the sacrum 56 to move from the dotted lines 56A back to its normal position.

Thus, the sacrum is a double wedge that rests between the iliac crests in a position of highest pain-free mechanical position. The distances of wedging movement are small, yet the pain-inflammation-spasm disability from this wedged joint cannot be relieved. Only by "antiwedging" techniques can this problem be solved.

The sacro-iliac (S-I) joints are very irregular in their surfaces and do not readily return to their original anatomic position once out of normal position. A normal muscle achieves a stretch in 15 seconds. An inflamed, toxic, anaerobic spasm-sustained muscle can relax only after a significantly longer period of time, 15 minutes or greater. All surrounding normal muscles will relax first, and then the lengthy process of spasm-relaxation and unwedging can begin.

It is the experience of many patients that a calf cramp or foot cramp, once relieved, has a propensity for respasm shortly after the release spasm prevents joints from going through their full range of motion. Muscles-in-spasm become, in effect, discreet entities which cut off blood, oxygen supply, nourishment and toxin removal. Surrounding muscles which are healthy can stretch sufficiently to "by-pass" a spasm in 15 seconds. If issues of comfort, safety and security are not addressed, adequate relaxation will not occur to allow the spasm to be overcome.

Arthritic and weakened patients often do not have sufficient strength to exercise and move joints through a range of motion because of the influence of gravity, i.e., their body weight. Spasms and continual use of the muscles and joints occurs. To move a lower extremity, the entire lower extremity must be lifted to begin active exercise.

Lower back problems can result from injury and resulting subsequent increased muscular tonicity of muscles, such as those represented by numerals 6 and 7 in FIG. 1, and other large muscle groups which do not appear in the very simplified diagram of FIG. 3. If such muscles become injured, they contract into sustained spasm, preventing spaces 2 and 3 from opening up even when the patient sleeps horizontally. The upper and lower surface tissue of disc D then begins to die, never to be replaced. In FIG. 1 there is a gap designated by arrows 10. Even a millimeter of closure of the gap 10 can result in pinching a portion of a nerve such as N4.

There is a triangular arrangement of three ligament connection points of each vertebrae to the vertebrae above or below it. If force thereon becomes sufficiently unbalanced, too much closure of the vertebrae LV4 in the direction of LV5 against disc D (for example) can result, producing "pinching" by a stressed muscle group on one side of the spinal column and causing excess force on that side, which produces a tilting between the two vertebrae, resulting in pinching of a nerve.

Traditionally, physicians, chiropractors, and others have utilized traction in various attempts to stretch the spine and open the nutrient passages 2 and 3 to allow nutrient solution to diffuse into those regions and nourish the upper and lower surfaces of the disc D. However, during traction, the patient's back muscles remain stressed. Furthermore, during traction most of the traction forces put undue stress on other parts of the body, such as the neck, shoulders, and upper spine.

If all of the relevant muscles are relaxed, only approximately 10–20 pounds of traction between an upper vertebra such as LV4 and a lower adjacent one such as LV5 of FIG. 1 is required to widen the "gap 10" a millimeter or two to relieve nerve pinching and allow efficient diffusion of nutrient fluid into passages 2 and 3. If this condition is maintained for at least half an hour, sufficient nutrient fluid will diffuse through passages 2 and 3 to nourish the upper and lower surfaces of disc D and the adjacent vertebrae surfaces, preventing premature dying of disc tissue and thus preventing the resulting thinning of the disc, decreasing of the gap 10, and pinching of the nerve N4, thereby relieving the resulting lower back pain.

Increased muscular tonicity from stress, pain, or constant pressure increases the strength of contraction of paralumbar muscles. This increases the hydrostatic pressure within the disc, forcing fluids and nutrients out, and prevents replacements thereof from entering. Disc nourishment normally occurs during sleep. Only minor increases in the pressure within the disc passages 2 and 3 will prevent it from being replenished with nutrient fluids. If the "relative pressure" within regions 2 and 3 for a person lying at rest is considered to be equal to 1, and if the person sits up, this raises the relative pressure to a value of 6. If the person then lifts a 20 pound package, the relative pressure is raised to a value of 20. Acting as an elastic tissue, the disc absorbs all of the extra pressure due to its shock-absorbing design, as long as it remains elastic. However, discs which lose a substantial amount of surface tissue due to dying of cells or lose disc contents (nucleus pulposus), do not remain elastic.

Further experimentation with the structure described with regard to FIGS. 5, 6, and 7 herein and in the above-identified copending parent application has shown that 20 pounds of traction weight is not essential to provide the traction needed across the sacro-iliac joints and the lumbar spine and the upper thoracic spine to allow efficient diffusion of nutrient fluid through passages 2 and 3 to nourish the disc. My further experimentation also has shown that some patients suffer from tiring of their neck muscles when using the structure of FIGS. 5, 6, and 7. For some patients the stress of carrying the twenty pound weight belts and the fully inflated floatation tube 20 prior to entering the water is unsatisfactory. My experiments also have indicated a need for longer periods of therapy in the water than previously thought necessary.

U.S. Pat. No. 4,722,329 discloses an apparatus for supporting a patient in water utilizing an overhead member supported by floatation. A connection around the supported person by means of a tight vest keeps the person's shoulder and head above the surface of the water. A weight belt is applied to the patient's hips, to apply tension to the person's neck. This reference has the shortcoming that the disclosed device does not allow adequate movement of the upper body, does not provide support for the person's arms, restricts the patient's breathing, and fails to emphasize the need to relax the patient's muscles extending from the sacrum and pelvis up to the patient's chest. This prevents the patient from executing a good range of symmetrical, muscle-relaxing exercises which are important to achieving the benefits of the traction that the apparatus of U.S. Pat. No. 4,722,329 is attempting to achieve. Furthermore, the device is difficult for the user to put on without help. The user probably needs to be in the water to put the apparatus of U.S. Pat. No. 4,722,329 on. The device of U.S. Pat. No. 4,722,329 does not provide a "counter traction" platform to enable the user to bend and flex or extend the spine while using the device.

There is an unmet need for an improved apparatus and method for rehydrating desiccated lumbar intervertebral discs and relieving low back pain and stress without the shortcomings of prior traction techniques and apparatus, yet provides mild, prescribed symmetrical traction, proper body temperature, mild body massaging, avoids constriction of breathing, avoids pinching of armpit nerves, and allows flexion, extension, and bending exercises for the low back with "negative" weight bearing on the lumbar spine. There is a further need for equipment and a technique for providing these benefits to stroke victims and other patients with significant neuromuscular impairments and to partially rehabilitate previously disabled muscles.

SUMMARY OF THE INVENTION

Accordingly, it is an object of the invention to provide a mild traction producing apparatus and technique that avoids imbalance caused by stressed muscle groups.

It is another object of the invention to provide an improved apparatus and technique that will produce mild, balanced traction on a person's lumbar spine that overcomes the shortcomings of the closest prior art by providing mild, symmetrical or non-symmetrical lower back traction, proper body temperature, mild body massaging, avoids constriction of breathing and pinching of armpit nerves, and allows back flexion and extension exercises.

It is another object of the invention to provide an apparatus and technique which improves prior techniques of "unwedging" a sacrum from an iliac by allowing effective vertical displacement of the sacrum relative to the iliac and returning of the sacrum to its natural position.

It is another object of the invention to provide a therapeutic environment conducive to total muscle relaxation so that very mild, sustained traction can be applied across the patient's knee and hip joints, lumbar spine, thoracic spine, cervical spine, and upper extremities.

It is another object of the invention to provide an environment and method for patients with stroke and other neuromuscular disabilities to facilitate involuntary contraction of disabled muscles as a result of voluntary contraction of other muscles to thereby achieve an active range of motion and tonicity in the disabled muscles.

It is another object of the invention to avoid neck pain in an aquatic traction system.

It is another object of the invention to provide an environment which facilitates manual manipulation of the spine, by providing significant reduction in spasm of the muscles overlying and protecting the areas of mechanical bone and joint problems.

Briefly described, and in accordance with one embodiment thereof, the invention provides a system for producing mild traction across the entire spine and the intervertebral discs by supporting a person in water in a deep spa or pool by means of a soft neck collar supported by the water, the spa or pool being sufficiently deep that the person's feet cannot touch the bottom thereof, supporting a submerged weight belt on each of the person's ankles, the weight belts each having a preselected buoyant weight, the buoyant weight of each of the belts being in the range from approximately one to two pounds, traction forces originating from the person's occiput extending across the cervical spine, the upper and lower thoracic spine, the entire lumbar spine, sacro-iliac joints, the hips and knees, and ankles, and maintaining the temperature of the water in the spa at approximately 96 degrees Fahrenheit, to allow adequate removal of the person's metabolic heat without causing shivering and increased tonicity of the person's muscles. The collar is inflatable and floats directly in the water. The level of inflation of the collar is adjusted so as to adjust the level of traction. In another embodiment, the person is supported in the water in a deep spa or pool by means of a soft, flexible floating annular floatation device engaging undersides of the person's arms adjacent to the person's armpits without compressing the person's chest and constricting the person's breathing so the traction forces originate from the person's upper thoracic spine and extend across the person's lower thoracic spine and entire lumbar spine, across the person's sacro-iliac joints, and across the person's knees. In another embodiment of the invention, contractions of neurologically disabled muscles are produced in a first limb of a person by supporting the person in water in the deep spa or pool either by means of a soft, flexible annular floatation device engaging undersides of the person's arms or by means of a soft neck collar supported by the water. The person is caused to extend an opposite second limb outward under voluntary control of muscles of that limb, and muscles of the disabled first limb automatically contract so as to counterbalance the opposite second limb.

BRIEF DESCRIPTION OF THE DRAWINGS

FIG. 1 is a partial section view diagram of a human spine.

FIG. 1A is a section view of the sacro-iliac joints taken through section line 1A—1A of FIG. 1B.

FIG. 1B is a simplified rear view diagram of the sacroiliac joints.

FIG. 2 is a perspective view of an arm-supporting floatation device used in accordance with the present invention.

FIG. 3 is a partial perspective section view of a deep spa utilized in conjunction with the method of the present invention.

FIG. 4 is a block diagram of a pumping and heating system utilized to supply water to the therapy jets of the deep spa of FIG. 3.

DETAILED DESCRIPTION OF THE PREFERRED EMBODIMENT

Figure 5:
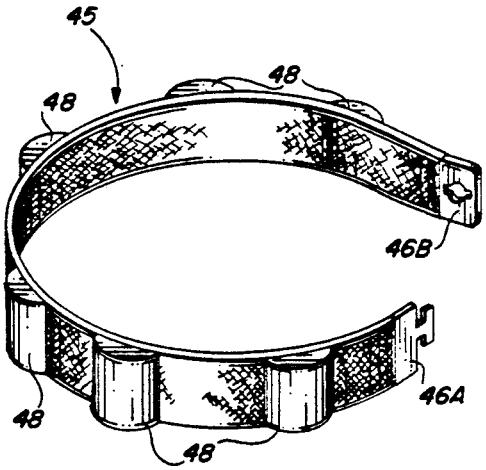
FIG. 5 is a perspective view of a symmetrical weight belt used in accordance with the present invention.

Referring now to the drawings, the present invention accomplishes the above objects by providing the combination of a relatively small, tube-like floatation device 20 which supports a patient's arms (rather than the patient's armpits), a specially constructed deep spa 25, the bottom of which is deep enough that the patient's toes cannot touch it, an optional spa pump, a water heater, therapy jets, and a submerged weight belt 45 with uniformly distributed weight. In FIG. 2, the floatation device 20 includes a preferably inflatable annular ring having an inside diameter of approximately 13–17 inches and an outside diameter of approximately 31–35 inches that would be suitable for a typical adult having a weight in the range of 95∝270 pounds. A pair of contoured arm supports 21 optionally are provided to provide comfortable support for the person's arms.

FIG. 3 shows a perspective sectional view of a spa 25, which is at least 6 feet in depth, and has a diameter of approximately 6 feet. Numerals 29 designate conventional therapy jets. Numeral 28 designates steps that allow entry into the deep spa cavity 27. Numeral 29A designates the drain/outlet of spa 25.

FIG. 4 shows the main components of the spa system, including a one and one-half horsepower pump 36, which circulates water in the spa through a heater 37 and into a spa inlet including the therapy jets 29. Water pumped from an outlet of spa 25 is drawn into the inlet of pump 36. It is important that the temperature not be too cold, because muscles become tense due to overexertion in trying to warm the body heat to an optimum temperature, and this may cause spasms in muscles. Muscle spasms, of course, tend to defeat the purpose of the invention. The water temperature must not be allowed to be too high because of danger of overheating to some people (including certain old persons, pregnant women, and other handicapped patients).

Figure 6:
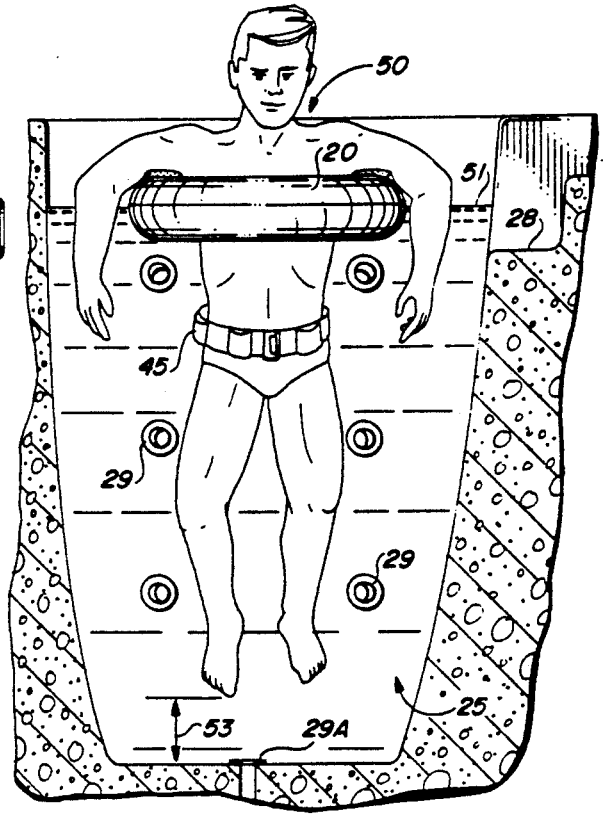
FIG. 6 is a section view diagram of a person being supported in the spa of FIG. 3 utilizing the floatation device and weight belt of the present invention.

FIG. 5 is a perspective view that shows a weight belt 45 used in accordance with the present invention. Weight belt 45 includes a pair of quick connect latch elements 46A and 46B and a plurality of weights 48, which may be symmetrically or asymmetrically distributed around the belt in accordance with the nature of the person's lower back problem. Weight belt 45 weighs 10–20 pounds, and is placed on the person's hips. When the person 50 wearing weight belt 45 is in the spa, as indicated in FIG. 6, his arms are supported on the armrests 21 of a floatation device such as 20 in the water 51 and his body therefore necessarily is supported by his arms, rather than by a tight vest around his chest, as described in above-mentioned U.S. Pat. No. 4,722,329. The weight belt 45 on the person's hips also is submerged. Because of its low buoyant effect, essentially the entire 10–20 pound weight of belt 45 is pressed downward on the person's hips, providing a small, completely symmetrical (or asymmetrical, if that is what the person's condition requires) traction force on the person's lumbar spine. Careful placement of the weights on the iliac crests can result in opening of selected sacroiliac joints, allowing realignment of the sacrum 56 and iliac crests 55A,B. This also results in opening of and a slight negative hydrostatic pressure within the regions 2 and 3 of FIG. 1, causing diffusion of nutrient fluid into those regions.

It should be noted that experiments have shown that increasing the weight of the weight belt 45 above 20 pounds increases upper back fatigue and defeats the purpose of prolonged gentle traction on the back.

It also should be noted that it may be beneficial in some cases to attach weights to the ankles or feet of a person supported in spa 25 as shown in FIG. 3, especially for arthritic patients.

Since the human body is almost neutrally buoyant when completely immersed in water, the present device provides that none of the thorax/lungs will be out of the water and the lower extremities therefore will be "negatively buoyant". The additional application of weights applied to the waist or lower extremities provides a net downward gravity force on the lower back. Thus, leg lifts, tilting of the lower body, and so forth against the floatation platform can be accomplished, and upper body aerobics, cardiovascular conditioning can be accomplished.

The warm temperature of the water and the motion produced by the jets of water ejected from the therapy heads 29, and the inability of the patient to touch the bottom of the pool with his/her feet, and the combination of temperature, time and relaxing environment with low traction needed to maintain the negative hydrostatic pressure inside the patient's spinal column, results in nourishment of the disc tissue. The patient's breathing is not constricted, and if it "feels right" to the patient, the patient can gentle exercises that enhance the relaxation effect and decrease the muscular tonicity of the muscles (such as 6 and 7 in FIG. 1, and also other muscle groups) that prevent the spaces 2 and 3 from opening up despite the mild traction being applied. Relaxing music can still further enhance the therapeutic experience of the patient.

The inability of the patient to touch the bottom of the pool with his/her feet also interrupts the normal primitive neuromuscular mechanism of the body. It is this primitive balance mechanism which of necessity is always at work when the body is supporting and balancing itself in a gravitation field. Supporting the patient in water, removing stimulus to the feet, and thereby removing the need for the body to balance itself, makes it possible to allow relaxation of the muscles in spasm. A muscle is a simple binary switching device: it should be fully relaxed when not being stimulated and should be capable of full contraction when required by the body to perform any function; when one muscle does not ever fully relax, the consequences of spasm as detailed herein are evident.

Figure 7:
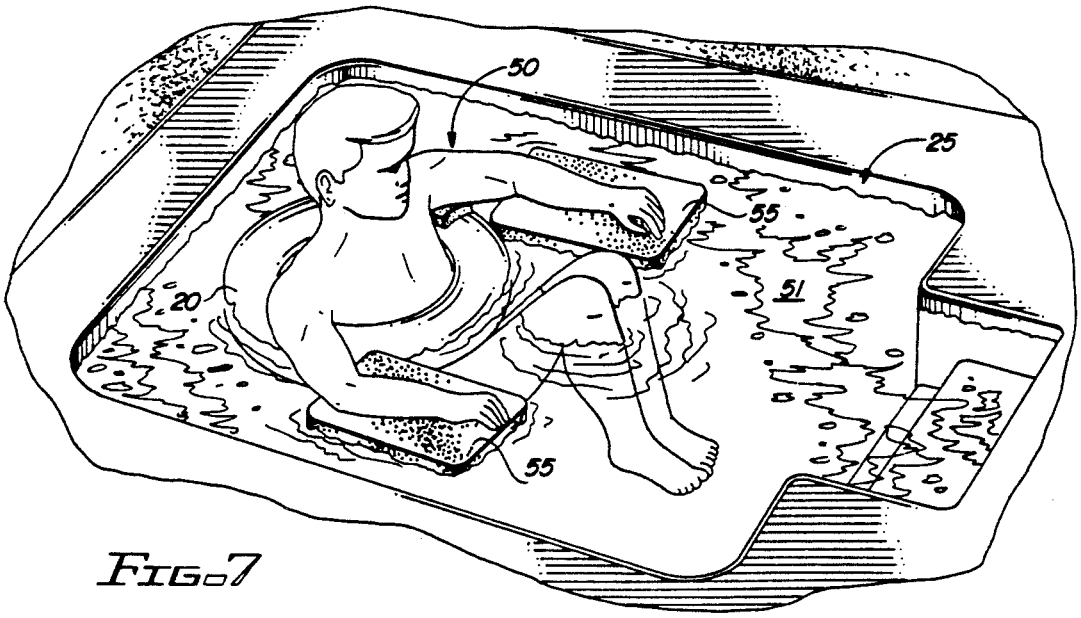
FIG. 7 is a perspective view illustrating use of hand floatation devices to perform gentle muscle-relaxing exercises before or during traction.

Typically, the patient would begin the therapy by spending 10 to 30 minutes of time floating vertically in the water, allowing the traction weight produced by the weight belt 45 or the ankle weights to gently stretch the entire spine. After this warm up, the patient performs exercises to put the back slowly through a series of flexions and extensions of his or her back against the resistance of the water, followed by side bends and rotations in both directions. The floatation device 20 serves as a stable "platform" from which such gentle exercises can be performed or as a counterbalance platform against which additional sets of gentle exercises can be performed. More strenuous, asymmetrical exercises can be performed using one or two separate hand supporting floats 55, as shown in FIG. 7, to allow forward and sideways leg lifts, and the like, and to allow various twisting exercises.

Approximately 1200 treatments based on the abovedescribed apparatus and method have been performed since filing the above-identified co-pending parent application. It has been found that the described "passive aquatic traction" can be advantageously applied with equal traction forces applied across every level of the spinal column, through the SI joints, the hips, and the knees. If the pneumatic floatation upward force is applied to the base of the patient's skull, the traction can be further developed across the shoulders, elbows, and wrists if traction forces are applied to the hands.

Traditional medical teaching for the origins of neck and back pain often rely upon the results of structural problems which can be identified on x-rays, CT scans, or MRI scans, or as a result of neurological problems which can be measured. Disc protrusions occur as a result of mechanical forces applied across them. By increasing the hydrostatic pressure within a disc, decreased oxygenation, decreased nutrition, decreased hydration, and increased accumulation of toxic metabolites occurs. The forces that maintain these mechanical structural problems are muscles in involuntary contraction. If such involuntary muscular contraction is sustained, then the same nutritional problems that occur in the discs also occur in the muscles, i.e., decrease in oxygen, water, and nutrition, and the accumulation of toxic metabolites. Once the muscle is in involuntary spasm, the effects of toxicity extend to adjacent muscle groups and the area of pain is increased. At this stage, simple mechanical realignment or readjustment is not sufficient to relieve the spasm, and the tendency is for the spasm to force the structural misalignment to reoccur, either spontaneously or with very minimal stress (cough, sneeze, bend, or twist).

"Postural muscles" are those which are responsible for maintaining the body in an upright position with the head held erect. To maintain body balance and the head erect, a two-legged man must have ever-constant and ever-changing responsiveness from these postural muscles, ready to increase their state of contraction to maintain balance. It is well known that one of man's inborn fears is that of falling. This fear seems to increase in the elderly, and seems to increase with inactivity which, according to aerobics exercise theory, leaves these postural muscles unexercised, weaker, and less responsive to changes in body position and ambulation. These include the muscles of the neck, the paraspinous muscles of the entire spine, and the muscles of the buttocks and lower extremities. In a healthy state, these muscles are in a constant state of balanced contraction when the body is upright, and are relaxed when the body is supine (as in sleep). If one of these postural muscles becomes spastic, and exerts a sustained contraction across a joint whether the body is erect or supine or in the water, then the muscles which are responsible for counterbalancing this muscle will also be maintained in a state of sustained contraction, further increasing the forces across the painful area but necessary to maintain the body and head erect.

As a result of experimentation with the new methodology, it has been found that after 30 to 60 minutes of passive postural muscle relaxation with light traction, adjacent muscles, which have not been protecting an area of mechanical misalignment are able to relax, permitting oxygen, nutrition, and water to enter these muscles and wash out toxic metabolites. At this stage in the treatment, the only areas of pain and/or awareness occur in the area of injury and in the muscles that have been in sustained spasm overlying the area of injury. This permits the patient to accurately identify and feel the area of injury and localize it.

Mechanical manipulation of this injured area is now facilitated, and the results of such mechanical manipulation are improved with a significant reduction in muscle tension across these areas reducing the forces which might "try" to have the injured parts return to their prior state (of misalignment and pain). Such postural muscle relaxation significantly reduces the overall tension in the postural muscles and facilitates mobilization of the area of injury.

Figure 8:
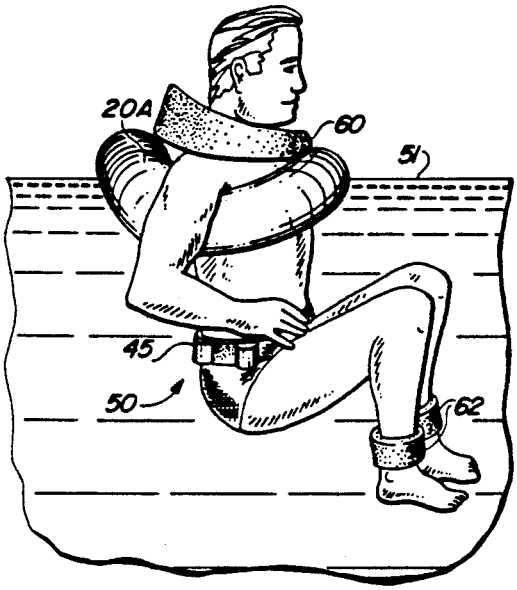
FIG. 8 is a side view diagram illustrating another embodiment of the invention.

FIG. 8 shows an alternate floatation structure including a soft, "floppy", partially inflated flexible tube-like floatation device 20A and a separate soft, supportive pneumatic neck collar 60 that rests on the upper portions of the floatation device 20A. The level of inflation and the flexibility of floatation device 20A is such that the arm and armpit of the patient 50 press the center portion of floatation device 20A down into the water 51, while the front and rear portions of floatation device 20A extend upward, supporting collar 60. Collar 60 supports the back of the patient's head and the patient's chin. The height of floatation and the amount of traction (i.e., the ankle weight minus the upward floatation force of the portion of the body under water) on the neck can be adjusted by the amount of inflation of pneumatic collar 60, the structure of which is further shown in FIG. 10A.

I have discovered that floatation device 20A and pneumatic collar 60, used in conjunction with light ankle straps 62, each of which can be less than 2 pounds in buoyant weight (i.e., weight when submerged in water) avoids some of the above-mentioned difficulties experienced using the apparatus shown in FIGS. 5 and 7, namely, tired necks, sore arms, and a desire to get out of the water before the maximum therapeutic benefits have been achieved.

I have discovered that an optimum water temperature is 96 degrees Fahrenheit. The water temperature is maintained at 96 degrees Fahrenheit by conventional heating and thermostatic devices. The average patient's skin temperature is 93.5 degrees, and his or her internal body temperature is 98.6 degrees. If the water temperature is less than 93.5 degrees Fahrenheit, the body feels the loss of heat and experiences chilling over time (sooner as water temperature drops). If the water temperature is about 94 degrees, the skin feels chilly and some of the body muscles tighten, which is undesirable for the traction therapy indicated in FIG. 8 with ankle weights of less than 2 pounds for each ankle and no other traction weights provided on the patient. If the water temperature is over 97 degrees, the body starts retaining metabolic heat and the patient will sweat and vasodilate, increasing the changes for hypotension and fainting when leaving the water (sooner as water temperature increases). I have found that a water temperature of approximately 96 degrees allows most people to dissipate metabolic body heat without producing muscle tightness that defeats the effectiveness of traction using very small ankle weights. I found that in some cases it is desirable for patients to remain in the water with the mild traction of the present invention for as long as two hours. Such long traction times are incompatible with water temperatures much different than 96 degrees Fahrenheit and excessive traction weight forces (excessive is a combined function of percentage of body fat, age, overall strength, and the body's requirements for increased pull).

The arrangement of FIG. 8 allows a range of flexing motion of the patient's abdominal muscles without increasing the muscular tension across the spine. The combined motion of a 4 pound weight belt and 2 pound ankle belts as shown allows abdominal muscle contraction similar to that achieved during situps, without comparable flexion-contraction of the patient's back muscles.

Figure 9:
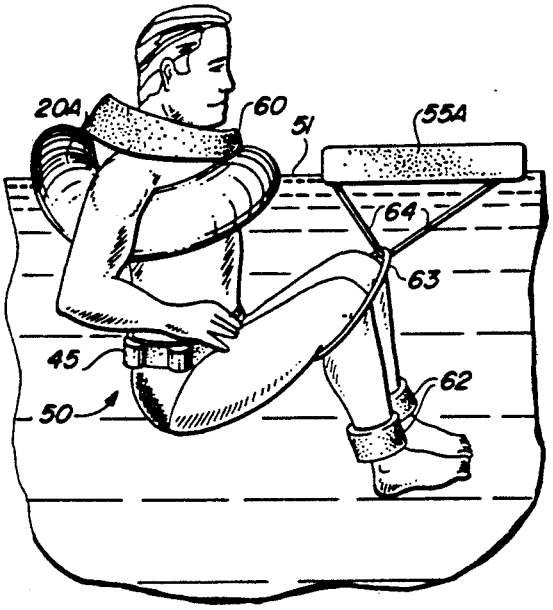
FIG. 9 is a side view diagram illustrating another embodiment of the invention.

FIG. 9 shows another embodiment of the invention in which the pneumatic collar 60 and the flexible floatation tube 20A are the same as in FIG. 8. In this case, however, a weight belt 45 having a buoyant weight of approximately 4 pounds is attached around the patient's waist. The patient's knees are held in a raised position by suitable loop 63 as shown, and loop 63 is supported by cord 64 and tied to a separate floatation device 55A. Two ankle weight belts of approximately 2 pounds each are attached to the patient's ankles.

The arrangement of FIG. 9 allows total relaxing of the patient's lower back muscles in such a way as to "push out" the lower back into a more kyphotic curve and thereby allow relaxation of back muscles which spasm in such a way as to arch the spine forward into a more lordotic curve.

Since arthritic joints usually have a decreased distance between the two bone ends and degenerative joint changes have occurred, the shorted distance mechanically limits the range of movement of arthritic joints. In the method of the present invention, very light traction across the arthritic joints together with postural muscle relaxation produces a slight "vacuum" or negative fluid pressure across all affected joints. The slight "vacuum" has the effect of increasing the flow of fluid into the joint and of increasing the space in the joint. The joint then can be moved through a greater range of active motions with reduced muscle tension and increased mobility. The warmth of the water facilitates this process.

In similar fashion, patients who have had joint surgery often experience painful movement. Pain and tension across the joints impede activity. In order to achieve a full range of motion, pain must be decreased and the joint must be able to be moved through a full range of motion. When the limb is submerged, the only resistance that must be overcome is that of the lead weight and minimal water resistance. Traction with lead weights, coupled with passive relaxation of the muscles of the limb over prolonged periods of time result in very effective gradual improvement in the range of mobilization of the joints.

A 30 year old male physician suffered a fraction dislocation of his left elbow in December 1990 and underwent surgery to correct the dislocation and remove bone fragments. This type of injury is well known for having the elbow not return to 100% function in spite of therapy. He presented himself for therapy the fifteenth day after surgery, the day following suture removal. Before his first therapy session, he had less than 10 degrees of supination and pronation from his splinted neutral position, and 15 degrees of flexion and extension of the elbow. His therapy consisted of having the body submerged to the neck with a 1.9 pound circular lead weight which was held in the left hand, and allowing the security of such a light weight stretch the joint gently over time, focusing on the four ranges of motion of the elbow joint and not pushing the joint into pain by too rapid a stretch. After his two hour therapy session, the patient was able to flex his elbow to 30 degrees, enough to touch the back of his head (the external occipital protuberance), and extend to 150 degrees. This range of motion of 120 degrees was compared with 15 degrees before the therapy, and was a result not previously expected. One year later, he feels the function of his left elbow is 100% and directly attributable to his fine results with this new therapeutic modality.

Figure 10:
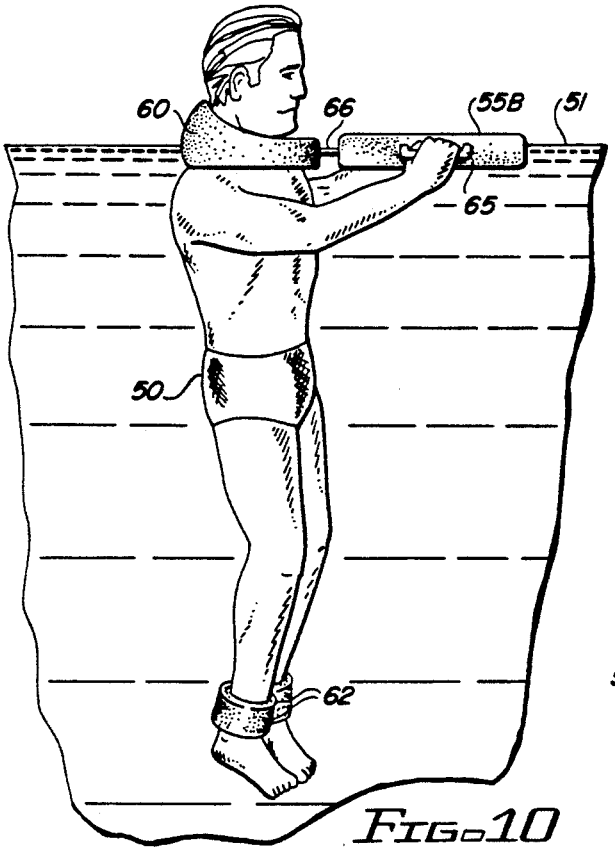
FIG. 10 is a side view diagram illustrating yet another embodiment of the invention.
Figure 10A:
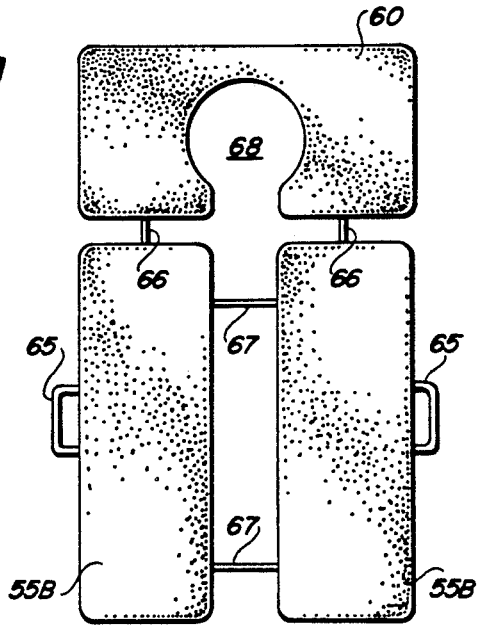
FIG. 10A is a plan view of the floatation apparatus used in the embodiment of FIG. 10.

FIG. 10 discloses another embodiment of the invention in which a pneumatic neck floatation device 60 floats on the water 51, rather than being supported by the floatation device 20A or 20B as shown in FIGS. 8 and 9. Two additional floatation devices 55B are connected by cord 66 to neck support floatation device 60, as best shown in FIG. 10A. Each of the floatation devices 55B has a handle 65. Floatation devices 55B are connected together by a pair of cords 67. By pulling on the handles 65, the patient can flex his or her back and abdominal muscles. Ankle weight belts 62, each approximately 2 pounds, are connected above the person's ankle, as shown. The patient, by pulling on the handles 65, can voluntarily control the amount of traction being applied between the base of his or her skull and the ankle belt 62, knowing that the traction will never exceed the buoyant weight of the ankle weight belt 62.

This embodiment of the invention allows the amount of effective traction applied across the patient's neck, thoracic and lumbar spines, hips, and knees to be set at a very low but effective level if complete muscular relaxation is first achieved.

Figure 11C:
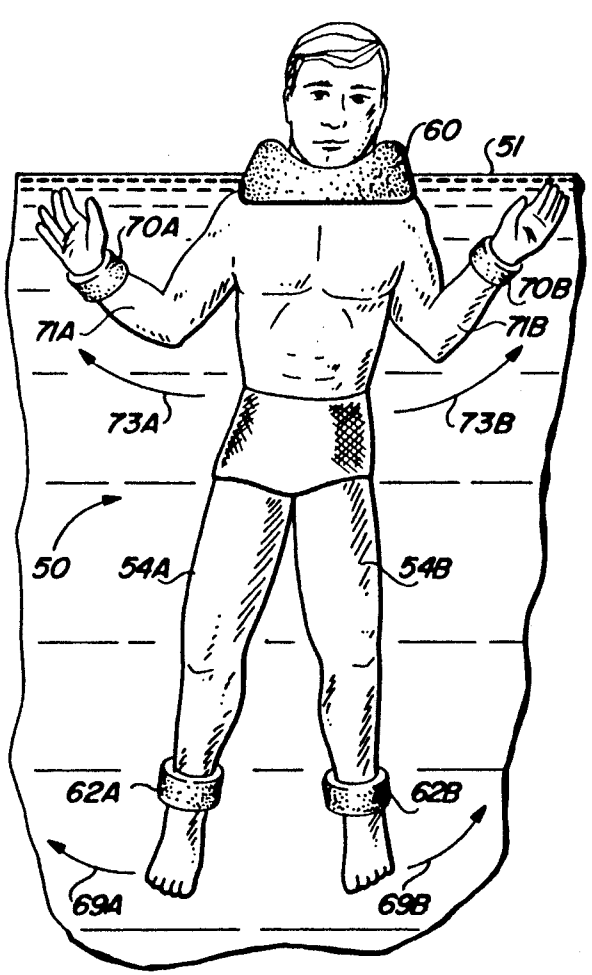
FIGS. 11A, 11B, and 11C constitute a sequence of diagrams useful in explaining one embodiment of the invention.
Figure 11B:
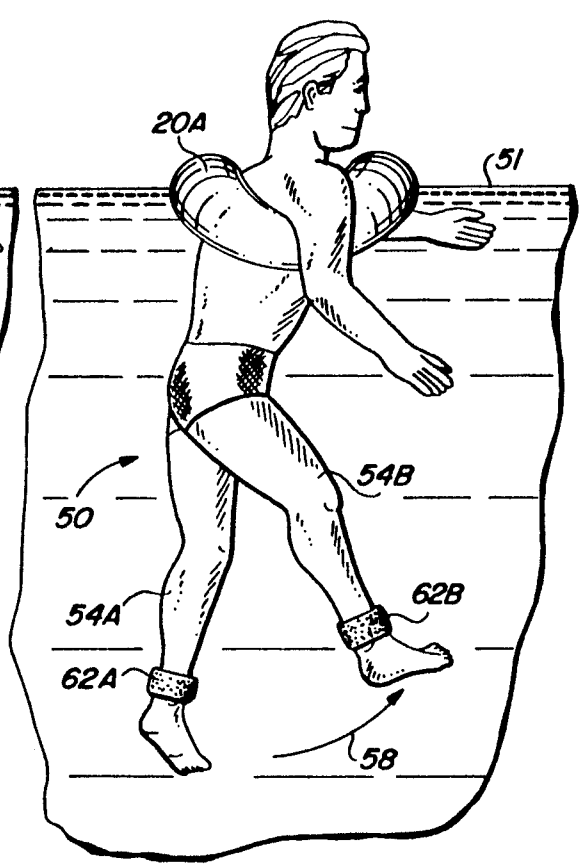
Figure 11A:
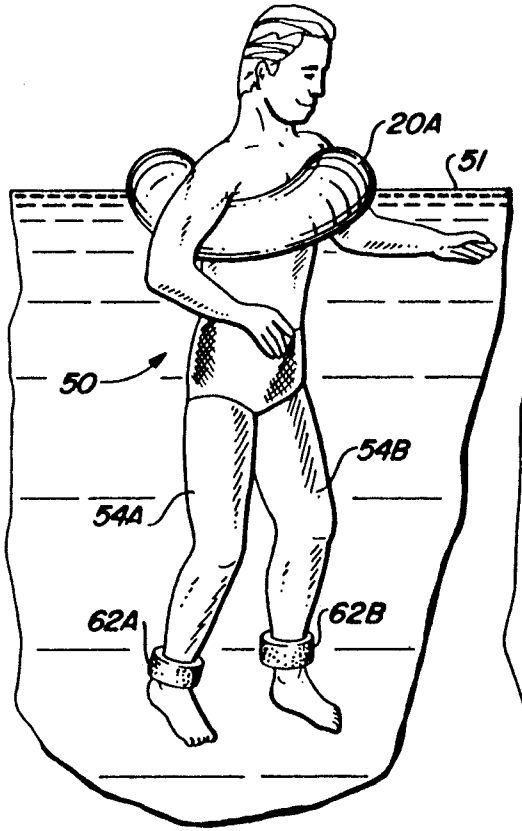

Referring to FIG. 11A, the patient's legs 54A and 54B with ankle weights 62A and 62B of about 2 pounds each thereon hang vertically from his or her hip if no leg muscles are flexed. If the leg 54B is strong, and leg 54A is disabled by a stroke, and the patient raises strong leg 54B as indicated by arrow 58, it would be expected that disabled leg 54A would continue to hang vertically as shown in FIG. 11B, and the patient's spine would tilt to counterbalance the force exerted by raising leg 54B. But this is not what I have observed.

I have observed that when the patient moves strong leg 54B forward in the direction of arrow 69B, weaker leg 54A automatically "counterbalances" this effect by extending rearward in the direction of arrow 69A a corresponding amount, so as to maintain the patient's head erect at a fulcrum point from which the body hangs. Increasing the amount of weight on strong leg 54B increases the amount of movement in weaker leg 54A.

When the fulcrum is moved up to the base of the skull, then a similar effect to that of weighted limb 54A in "counterbalancing" the movement of the other weighted limb 54B also applies to both arms 71A and 71B hinged at the patient's shoulders.

In several cases, after 10 to 70 treatments over a period of 11 months, patients continue to achieve increased levels of control of previously stroke-disabled muscles. Apparently, there is a "reflex arc" capability in the spinal cord which functions as a balance mechanism that produces a counterbalance reflex by one leg or arm when the opposite arm or leg is extended in an unbalancing manner.

In traditional medical theory, a patient with a cerebral vascular injury (e.g., a stroke) sustains an injury to the brain that results in the inability of the patient to spontaneously move the affected limbs supplied by that area of the brain. (This also applies to other neuromuscular disorders which result in weakness and loss of coordination of limbs). Rehabilitation of such patients involves them attempting motor activity while they are unbalanced and unsteady, with a high risk of falling and suffering hip fracture or the like. In the presence of gravity no partial voluntary movement of an extremity by such patients is possible. Patients undergoing such traditional physical therapy require one or two assistants, are usually maximally rehabilitated within 6 to 9 months such that no further improvement is expected or observed.

I have discovered that when a stroke patient is in the apparatus as shown in FIG. 10 light traction weights on the ankles (or wrists), intentional movement of the limb unaffected by the stroke in the forward direction results in backward movement of the affected limb. Whichever way the unaffected limb is moved, the affected limb moves to "counterbalance" the effect of the weight on the end of the limbs. Possibly, this is mediated through a spinal reflex arc, and is not the result of movement control originating directly in the brain and therefore bypasses the stroke-affected region of the brain.

The part of the central nervous system responsible for maintaining balance perhaps is activated, and in any event it permits activity and strengthening of the stroke-affected limb in an incremental progressive fashion until sufficient strength and coordination are developed for this improvement to be transferred to improved ambulation on land. Coordination is the result of repeatedly being able to accomplish a desired body movement, implying sufficient strength to move the limb. The same path for learning strength and coordination in rehabilitation of stroke-affected patients occurs as occurred previously in their infancy and childhoods: making the transition from random weak uncoordinated motor movements to strong purposeful coordinated movements through the process of practice, practice, practice.

A 66 year old woman had a first stroke in 1985 and a second stroke in 1987 following mitral valve surgery. She was left with significant weakness and impairment of function in her right leg and right arm as well as her speech. This impairment was the residual following traditional physical therapy and rehabilitation, but did not include the use of any water therapy. Before therapy according to the present invention, she walked with a list to the left leaning very heavily on a 4-pronged cane held in her left hand and wearing a plastic AFO ankle support. In her first treatment, she was able to actively move her stroke-affected right leg through the counterbalancing effects created by exercising the left leg. Only counterbalancing movement occurred this first session. By the fourth session, the counterbalancing movements were able to be brought under some voluntary control and coordinated movements of both legs began. After a few weeks of treatment once a week for two hours a session, she was able to produce enough coordinated activity of her lower extremities that she was able to make circular movements and "bicycle" back and forth across the pool in a straight line; the first effort resulted in 90 degree turns and straight line movement was not possible. She continued with this therapy once a week for the next three months.

After three months of therapy, her balance and strength had improved so that she only needed a one-point cane to assist ambulation. During the next three months of weekly therapy, her improvement in strength and coordination continued and she became able to use her right arm to push and pull her body in the water using a grab rail in the water. The tension in the right hand decreased and spontaneous gross motor movements of the right shoulder and elbow occurred. After six months of therapy, the patient was able to initiate ambulation and walk with an alternating gait without using a cane. Therapy was increased to three times a week after the sixth month. After eight months of therapy, the patient was able to take her first vacation by herself since 1985. After ten months of therapy, the patient no longer needed her AFO ankle support. After 11 months of therapy, she walked up the stairs to exit therapy.

While the invention has been described with reference to a particular embodiment thereof, those skilled in the art will be able to make various modifications to the described embodiment without departing from the true spirit and scope of the invention.

What is claimed is:

1. A method for producing mild traction on intervertebral discs, comprising the steps of:

(a) supporting a patient in water in a deep spa or pool by means of a soft neck collar supported by the water, the spa or pool being sufficiently deep that the person's feet cannot touch the bottom thereof;

(b) supporting a submerged weight belt on each of the patient's ankles, the weight belts each having a preselected buoyant weight, the buoyant weight of each of the belts being in the range from approximately one to two pounds, traction forces originating from the patient's neck extending across the patient's upper thoracic spine, lower thoracic spine and entire lumbar spine, across the patient's sacro-iliac joints, and across the patient's knees; and (c) maintaining the temperature of the water in the spa at approximately 96 degrees Fahrenheit, to allow adequate removal of the patient's metabolic heat without causing tonicity of the patient's muscles.

2. The method of claim 1 wherein the collar is inflatable and floats directly in the water, and the method includes adjusting the level of inflation of the collar so as to adjust the level of traction.

3. An apparatus for producing mild traction on a patient's intervertebral discs, comprising in combination:

(a) a soft neck collar supported by water in a deep spa or pool and supporting the patient in the water, the spa or pool being sufficiently deep that the person's feet cannot touch the bottom thereof;

(b) a submerged weight belt on each of the patient's ankles, the weight belts each having a preselected buoyant weight, the buoyant weight of each of the belts being in the range from approximately one to two pounds, traction forces originating from the patient's neck extending across the patient's upper thoracic spine, lower thoracic spine and entire lumbar spine, across the patient's sacro-iliac joints, and across the patient's hips and knees; and (c) means for maintaining the temperature of the water in the spa at approximately 96 degrees Fahrenheit, to allow adequate removal of the patient's metabolic heat without causing tonicity of the patient's muscles.

4. The apparatus of claim 3 wherein the collar is inflatable and floats directly in the water, and the method includes adjusting the level of inflation of the collar so as to adjust the level of traction.

5. A method for producing mild traction on intervertebral discs, comprising the steps of:

(a) supporting a person in water in a deep spa or, pool by means of a soft, flexible floating annular floatation device engaging undersides of the person's arms adjacent to the person's armpits without compressing the person's chest and constricting the person's breathing, the spa or pool being sufficiently deep that the person's feet cannot touch the bottom thereof;

(b) supporting a submerged weight belt on each of the person's ankles, the weight belts each having a preselected buoyant weight, the buoyant weight of each of the belts being in the range from approximately one to two pounds, traction forces originating from the person's upper thoracic spine extending across the person's lower thoracic spine and entire lumbar spine, across the person's sacro-iliac joints, and across the person's knees; and (c) maintaining the temperature of the water in the spa at approximately 96 degrees Fahrenheit, to allow adequate removal of the person's metabolic heat without causing tonicity of the person's muscles.

6. An apparatus for producing mild traction on a patient's intervertebral discs, comprising in combination:

(a) a soft, flexible annular floatation device supported by water in a deep spa or pool and engaging undersides of the person's arms adjacent to the person's armpits and supporting the person in the water without compressing the person's chest and constricting the person's breathing, the spa or pool being sufficiently deep that the person's feet cannot touch the bottom thereof;

(b) a submerged weight belt on each of the person's ankles, the weight belts each having a preselected buoyant weight, the buoyant weight of each of the belts being in the range from approximately one to two pounds, traction forces originating from the person's upper thoracic spine across the person's lower thoracic spine and entire lumbar spine, across the person's sacro-iliac joints, and across the person's knees; and (c) means for maintaining the temperature of the water in the spa at approximately 96 degrees Fahrenheit, to allow adequate removal of the person's metabolic heat without causing tonicity of the person's muscles.

* * * * *